US008585564B2

(12) United States Patent
Webb

(10) Patent No.: US 8,585,564 B2
(45) Date of Patent: Nov. 19, 2013

(54) WEIGHT STACK ASSEMBLY FOR EXERCISE MACHINE

(75) Inventor: Gregory M. Webb, Independence, VA (US)

(73) Assignee: Med-Fit Systems, Inc., Independence, VA (US)

( * ) Notice: Subject to any disclaimer, the term of this patent is extended or adjusted under 35 U.S.C. 154(b) by 99 days.

(21) Appl. No.: 13/104,370

(22) Filed: May 10, 2011

(65) Prior Publication Data

US 2012/0208679 A1 Aug. 16, 2012

Related U.S. Application Data

(60) Provisional application No. 61/333,913, filed on May 12, 2010.

(51) Int. Cl.
*A63B 21/06* (2006.01)

(52) U.S. Cl.
USPC ..... 482/93; 482/97; 482/98

(58) Field of Classification Search
USPC ..... 482/92–94, 97–103
See application file for complete search history.

(56) References Cited

U.S. PATENT DOCUMENTS 353,089 A * 11/1886 Smith ..... 482/102

* cited by examiner

*Primary Examiner* — Loan Thanh
*Assistant Examiner* — Rae Fischer
(74) *Attorney, Agent, or Firm* — Myers Bigel Sibley & Sajovec, P.A.

(57) ABSTRACT

A weight stack assembly for an exercise machine includes: a plurality of weights arranged in a vertical stack; a post extending through the weights, and a selector unit. Each of the weights includes an open-ended, forwardly facing slot, wherein the slots of each of a first set of the weights form a first column, and wherein the slots of each of a second set of the weights form a second column that is parallel to but non-coincident with the first column. The vertical stack is formed by alternating first and second weight. The post is configured to connect with a movement arm of an exercise machine and includes a first column of apertures that align with the slots of the first set of weights and a second column of apertures that align with the second set of weights. The selector unit is configured to be inserted into one of the slots and one of the apertures to select a portion of the weights to provide resistance for exercise.

14 Claims, 7 Drawing Sheets

WEIGHT STACK ASSEMBLY FOR EXERCISE MACHINE

RELATED APPLICATION

This application claims priority from U.S. Provisional Application No. 61/333,913, filed May 12, 2010, the disclosure of which is hereby incorporated herein in its entirety.

FIELD OF THE INVENTION

The present invention relates generally to exercise equipment, and relates more particularly to resistance systems for exercise equipment.

BACKGROUND OF THE INVENTION

Exercise devices, and in particular weight training machines, typically include a mechanical member that the user moves along a prescribed path for exercise. Conventionally, movement of the mechanical member is resisted in some fashion to render the movement more difficult and thereby intensify the exercise. The most common means for providing resistance to movement of the mechanical member is a unit that connects the mechanical member with one or more weights such that the weights are raised in response to the movement of the mechanical member.

Often the weights of an exercise machine are provided in a stack; any or all of the weights (which are typically identical in weight) can be secured to a connecting rod that extends through the entire weight stack via apertures in the weights. The connecting member is then interconnected with the mechanical member, either directly or indirectly, via a one or more of belts, chains, cables, levers, or other means. Movement of the mechanical member by a user is resisted by the weight secured to the connecting rod.

In one commonly employed configuration, the weights are secured to the connecting rod via a selecting pin, which can be inserted through an aperture included in each weight or a gap between weights and into an opening in the connecting rod. Insertion of the connecting pin into a connecting rod aperture causes the portion of the weights in the stack above the pin (i.e., those weights positioned between the pin and the interconnecting belt) to travel as a substack with the connecting rod and thereby provide resistance to movement of the exercise arm; the portion of the weights in the stack below the pin (i.e., those weights positioned farther from the interconnecting belt than the pin) remain stationary and provide no resistance to movement of the exercise arm. Of course, the amount of weight providing resistance to the movement is equal to the weight of the substack of weights travelling with the connecting rod. The amount of resistive weight can be easily adjusted by repositioning the selecting pin in the connecting rod in a different weight or between different weights so that a different number of weights travel with the connecting rod.

Space limitations often restrict the number of weights that are included in a weight stack. Because it is desirable to provide exercise machines that can be comfortably used by virtually any user (which may include both weak or infirm individuals using the machine for rehabilitation and very strong individuals for whom substantial resistance is required), the weights typically provided are rather heavy. Also, generally the individual weights in a stack are of the same magnitude. As the weights in a stack are generally both heavy and uniform in magnitude, the incremental increase in resistance experienced by a user adding but a single weight to the travelling substack can be quite significant. Such an increase can be particularly onerous for novices, rehabilitation patients, elderly users, and others who lack strength.

One attempt to address the problem of an overly high incremental weight increase is offered in U.S. Pat. No. 4,834,365 to Jones. The Jones machine includes two weight stacks: one stack comprising conventional heavier weights; and one stack comprising much lighter weights. These stacks are positioned so that the stack of lighter weights resides directly above the stack of heavier weights. Both stacks share a common connecting rod to which a portion of their weights can be secured. When the mechanical member of the exercise machine is moved, the desired number of weights of both stacks travel with the connecting rod and provide resistance. The lighter weights contribute to the resistance experienced by the user and therefore provide more resistance magnitude options. For example, a rehabilitating patient may be exercising on a machine that has a large weight stack of twenty pound weights and a lighter weight stack of one pound weights. If the patient's rehabilitation is best served by a resistance of thirty pounds, he can add resistance in one pound increments with the heavier weight stack to a twenty pound weight from the heavier stack to total thirty pounds rather than being forced to proceed directly from twenty to forty pounds of resistance.

Another approach is discussed in U.S. Pat. No. 5,776,040 to Webb, which includes separate stacks of lighter (e.g., one-pound) and heavier (e.g., ten-pound) weights, each with its own connecting rod and pin. The weight stacks are positioned side-by-side. Each connecting rod is attached to its own belt, with the belts following similar paths over pulley assemblies that are coupled to a movement arm. By selecting weights from both weight stacks, the exerciser can select precisely an amount of weight desired for resistance.

In view of the foregoing, it may be desirable to provide additional weight systems that provide resistance in small increments.

SUMMARY OF THE INVENTION

As a first aspect, embodiments of the present invention are directed to a weight stack for an exercise machine. The weight stack comprises a plurality of weights arranged in a vertical stack. Each of the weights includes an open-ended, forwardly facing slot. The slots of each of a first set of the weights form a first column, and the slots of each of a second set of the weights form a second column that is parallel to but non-coincident with the first column. The vertical stack is formed by alternating first and second weights. In this configuration, the weight stack can comprise thinner (and therefore lighter) weights than are typically employed, which can in turn enable the resistance to be selected more precisely, without the need for an auxiliary weight stack.

As a second aspect, embodiments of the present invention are directed to a weight stack assembly for an exercise machine comprising: a plurality of weights arranged in a vertical stack; a post extending through the weights, and a selector unit. Each of the weights includes an open-ended, forwardly facing slot, wherein the slots of each of a first set of the weights form a first column, and wherein the slots of each of a second set of the weights form a second column that is parallel to but non-coincident with the first column. The vertical stack is formed by alternating first and second weight. The post is configured to connect with a movement arm of an exercise machine and includes a first column of apertures that align with the slots of the first set of weights and a second column of apertures that align with the second set of weights. The selector unit is configured to be inserted into one of the slots and one of the apertures to select a portion of the weights to provide resistance for exercise.

As a third aspect, embodiments of the present invention are directed to a weight for an exercise machine, comprising: a body portion with parallel upper and lower surfaces, opposed side edges, and opposed front and rear edges; an open-ended slot extending from the front edge of the body portion; and an aperture located generally in the center of the body portion. The slot is connected with the aperture and is off-center relative to the side edges of the body portion.

DETAILED DESCRIPTION OF EMBODIMENTS OF THE INVENTION

Figure 1:
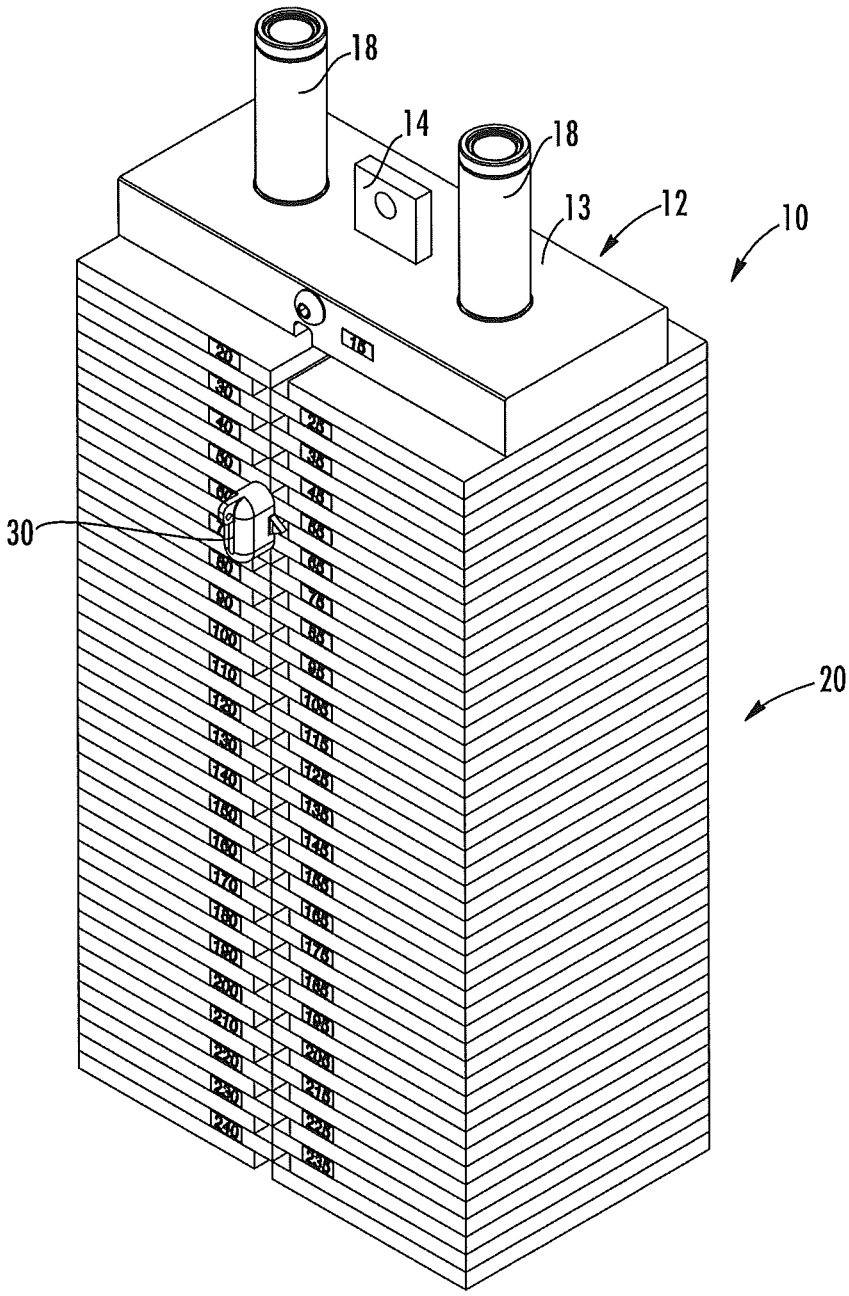
FIG. 1 is a perspective view of a weight stack for an exercise machine according to embodiments of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Well-known functions or constructions may not be described in detail for brevity and/or clarity.

Referring now to the drawings, a weight stack assembly for an exercise machine, designated broadly at 10, is shown in FIGS. 1-9. The weight stack assembly 10 comprises a top weight 12 and a plurality of weights 20 arranged in vertically stacked relationship. The top weight 12 has a generally flat body 13. A center post 15 (best seen in FIG. 4A) extends below the body 13 through the stacked weights 20, and also forms an attachment tab 14 that extends above the body 13 for attachment to a rope, cable or the like that is connected, either directly or indirectly, to a movement arm of an exercise machine. The center post 15 includes two columns of holes 16*a*, 16*b* that are arranged in staggered fashion (see FIG. 4A). The top weight 12 is also attached to bushings 18 that surround guide rods (not shown) that help to guide the weight stack 10 as some or all of the weights 20 are raised vertically during exercise.

Each of the weights 20 is substantially identical to the other weights 20. As such, only one weight 20 is described in detail herein, with the understanding that the discussion is equally applicable to the other weights 20 also.

Figure 5:
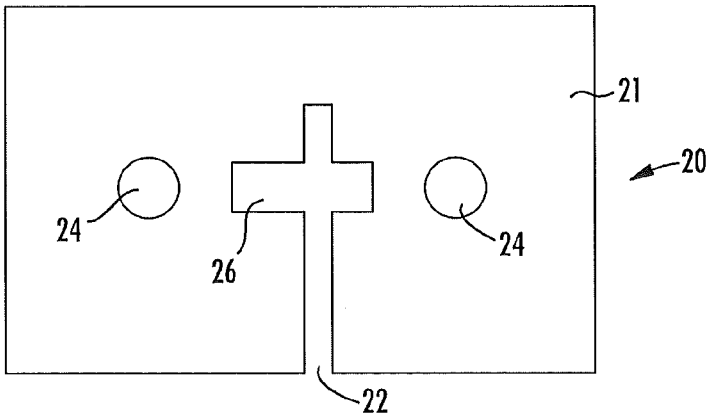
FIG. 5 is a top view of a weight of the weight stack of FIG. 1.

Referring now to FIG. 5, it can be seen that each of the weights 20 includes a generally flat body portion 21. An open-ended, forwardly-facing slot 22 extends from the front edge of the weight 20 to a centrally-located, generally rectangular post aperture 26, wherein the center post 15 is received, then further rearwardly from the post aperture 26. Notably, the slot 22 is slightly offset from the center of the body portion 21 relative to the side edges of the body portion, such that it aligns with one or the other of the columns of holes 16*a*, 16*b* of the center post 15. Each weight 20 also includes a pair of holes 24 that are aligned with the bushings 18 of the top weight to receive the guide rods of the system. In some embodiments, the weights 20 are five pound weights, although any magnitude can be employed with the present invention. In certain embodiments, the weights are between about ¼ or ⅜ inch to ⅝ or ¾ inch in thickness; in some embodiments they may be in as thick as ⅜ to ½ inch.

Figure 2:
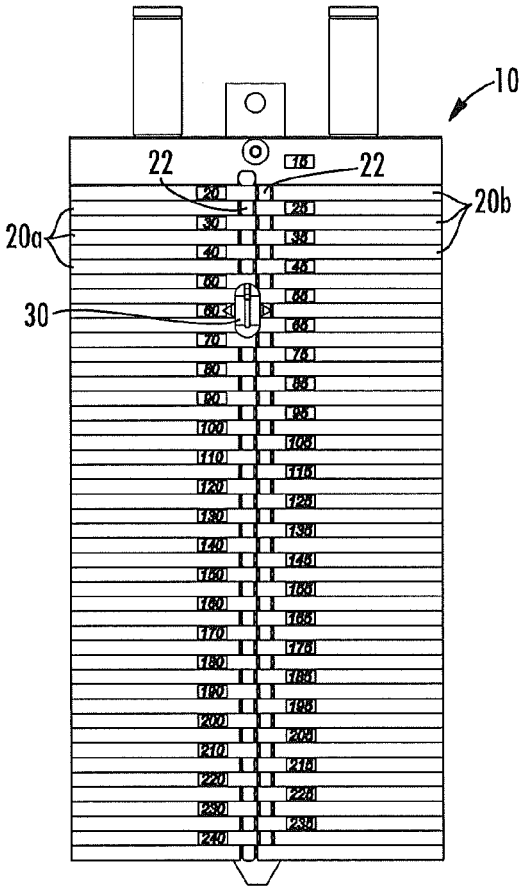
FIG. 2 is a front view of the weight stack of FIG. 1.
Figure 3:
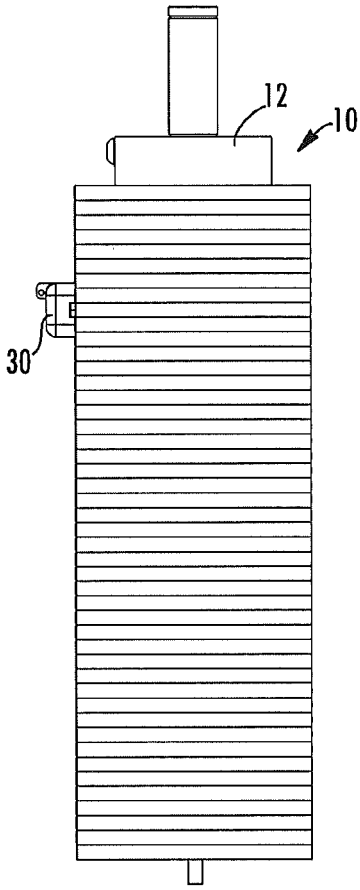
FIG. 3 is a side view of the weight stack of FIG. 1.
Figure 4:
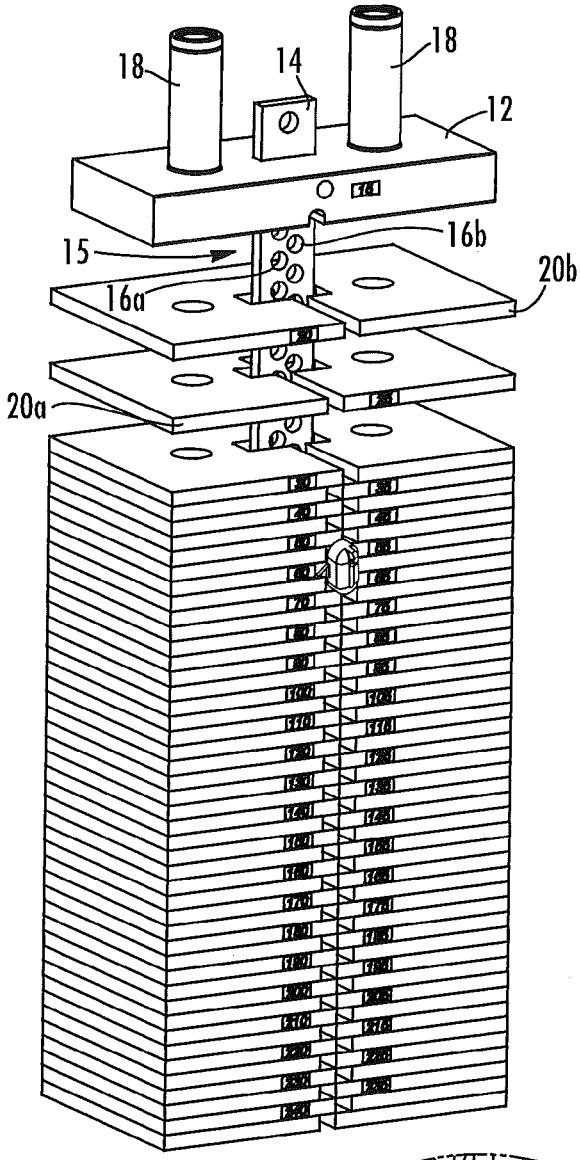
FIG. 4 is a partially exploded perspective view of the weight stack of FIG. 1.
Figure 4A:
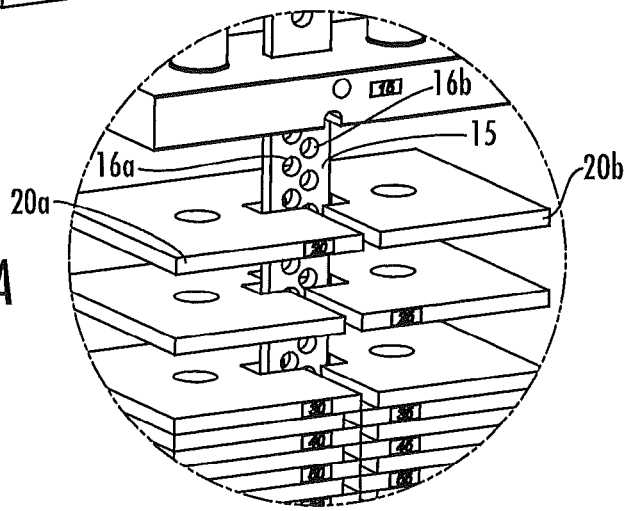
FIG. 4A is an enlarged perspective view of the area "A" of FIG. 4.

As can be seen in FIGS. 1-4, the weights 20 are arranged in vertically stacked fashion, with alternating weights being inverted. As such, when vertically stacked the weights 20 can be subdivided into a set of weights 20*a*, which are oriented such that the slot 22 of each weight 20*a* is positioned to the left of a centerline defined by the center post 15, such that the slots 22 form a first column, and a group of weights 20*b*, in which each weight 20*b* is inverted relative to the weights 20*a*, such that each weight 20*b* has its slot 22 positioned to the right of the centerline defined by the center post 15, with these slots forming a second column that is parallel to but non-coincident with the first column. As shown in FIGS. 1, 2 and 4, individual weights 20*a*, 20*b* alternate within the weight stack 20. Notably, the slots 22 of the weights 20 align with either the column defined by the holes 16*a* of the center post 15 (in the case of the weights 20 or with the column defined by the holes 16*b* (in the case of the weights 20*b*); this is best seen in FIG. 4A. Also, each weight 20 is of a thickness such that, when arranged in a vertical stack as shown in FIGS. 1-4, the weight 20 is level with one of the holes 16*a*, 16*b*. As a result, each of the holes 16*a*, 16*b* can be accessed through one of the slots 22.

Figure 6:
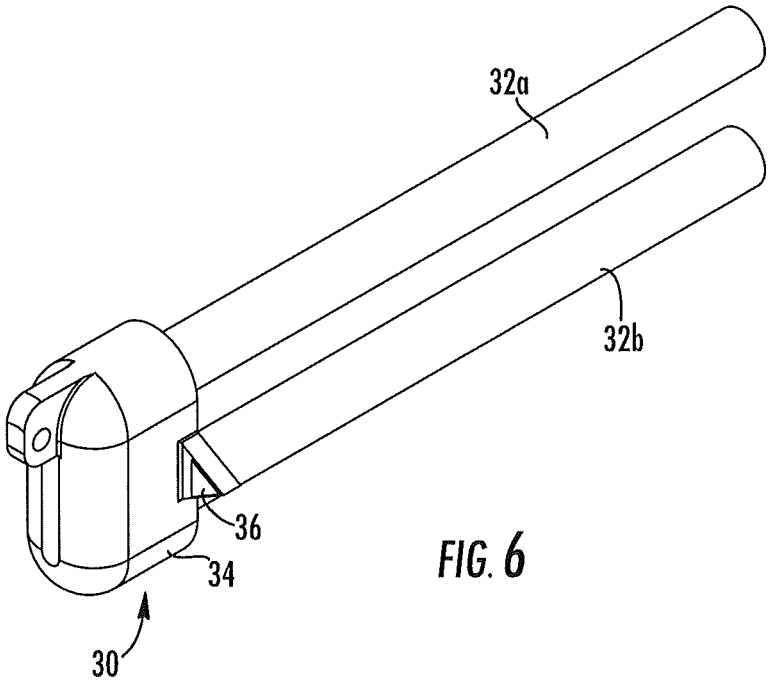
FIG. 6 is a perspective view of the selector fork employed with the weight stack of FIG. 1.
Figure 7:
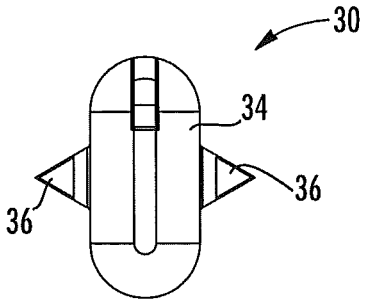
FIG. 7 is an end view of selector fork of FIG. 6.

A selector fork 30 is shown in FIGS. 6 and 7. The selector fork 30 includes two prongs 32*a*, 32*b* that extend from a head 34. Two pointers 36 extend from the head 34, one from each side, such that the pointers 36 define generally a right angle to an axis defined by the prongs 32*a*, 32*b*.

As shown in FIGS. 1-4, the selector fork 30 can be inserted into the weights 20 by orienting the head 34 so that the prongs 32*a*, 32*b* are vertically aligned. In this orientation, the prongs 32*a*, 32*b* can be received within respective slots 22 of two adjacent weights 20*a* that are separated by a weight 20*b*. Once in the slots 22, the prongs 32*a*, 32*b* are inserted into the holes 16*a* of the center post 15 that correspond to those particular slots 22. In this position, the lower of the prongs 32*a*, 32*b* will underlie the weight 20*b* immediately above it and support it from underneath.

Figure 8:
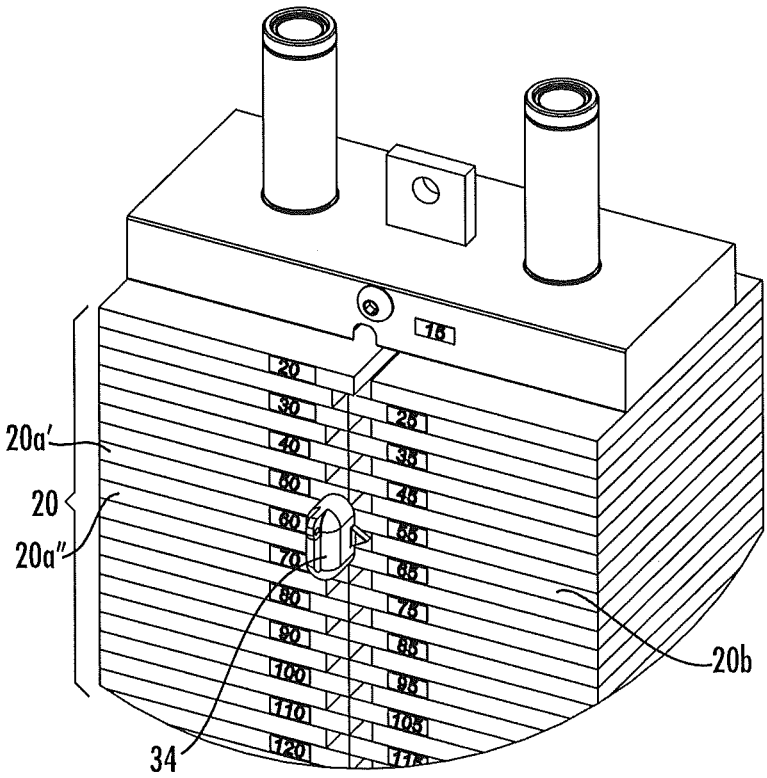
FIG. 8 is an enlarged perspective view of the weight stack of FIG. 1 with the selector fork shown in a first position, in which 60 pounds of resistance is selected.
Figure 9:
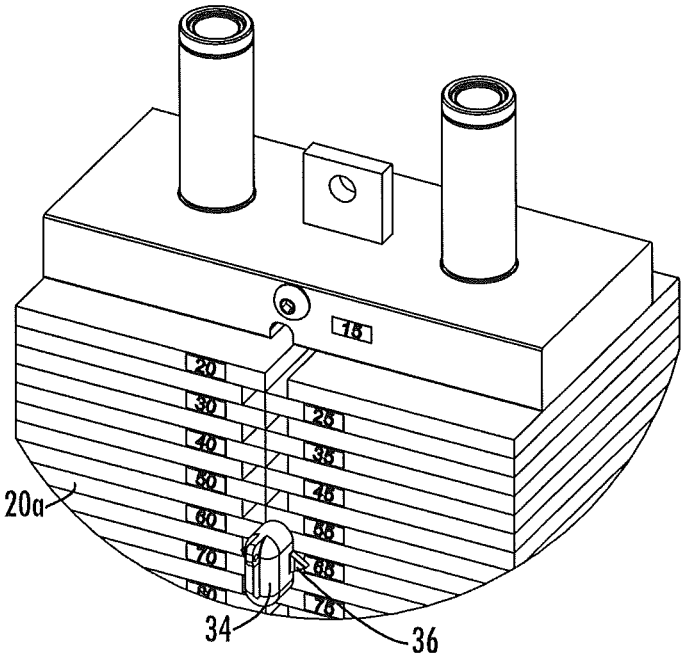
FIG. 9 is an enlarged perspective view of the weight stack of FIG. 1 with the selector fork shown in a second position, in which 65 pounds of resistance is selected.

In selecting a particular resistance for exercise, the exerciser should insert the selector fork 30 so that the weight 20*b* positioned between the two adjacent weights 20*a* that receive the selector fork prongs 32*a*, 32*b* represents the desired resistance. For example, in FIG. 8, the upper weight 20*a*' is designated "55", the lower weight 20*a*" is designated "65", and the middle weight 20*b* therebetween is designated "60"; the resistance that would be provided by such insertion would be the 60 pounds of the middle weight 20*b*. As can be seen in FIG. 8, the pointers 36 are positioned so that the pointer 36 on the left side of the selector fork 30 points to the middle weight 20*b* upon insertion of the selector fork 30 into the slots 22, thereby clearly indicating to the exerciser the magnitude of the resistance.

As the exerciser manipulates a movement arm (and, in turn, raises the center post 15) during exercise, the magnitude of resistance is determined by the number of weights 20 selected via the selector fork 30 to rise with the center post 15. As can be discerned from FIG. 8, the lower prong 32*b* fits within the slot 22 of the lower weight 20*a*" and immediately below the body portion 21 of the middle weight 20*b* immediately thereabove (i.e., the weight 20*b* located between the prongs 32*a*, 32*b*). Because the lower prong 32*b* supports the middle weight 20*b* from underneath, raising of the center post 15 via movement of the movement arm lifts the middle weight 20*b* and the weights 20 above it, thereby providing resistance to the movement of the movement arm; however, because the lower prong 32*a* simply fits within the slot 22 of the lower weight 20*a*", the lower weight 20*a*" and the weights 20 below the lower weight 20*a*" do not travel upwardly with the center post 15.

The selector fork 30 is used in the fashion shown in FIG. 8 to select as resistance weights 20*b* that are oriented with their slots 22 aligned with the column of holes 16*a*. It can be seen in FIG. 9 that the user can select weights 20*a* that are oriented with their slots 22 aligned with the column of holes 16*a* by inserting the prongs 32*a*, 32*b* into the slots 22 that are aligned with the column of holes 16*b*. In this position, the pointer 36 on the right side of the head 34 indicates the magnitude of the resistance to be experienced by the exerciser. Thus, the single selector fork 30 can be used to select any incremental magnitude of resistance that can be created with the weights 20.

The presence of the two columns of slots 22 can enable the use of thinner (and thus lighter) weights 20 than are typically employed for weight stacks of this type. As a result, the degree of resistance for exercise can be more precisely selected even though the weight stack may occupy the same volume as in prior machines.

Figure 10:
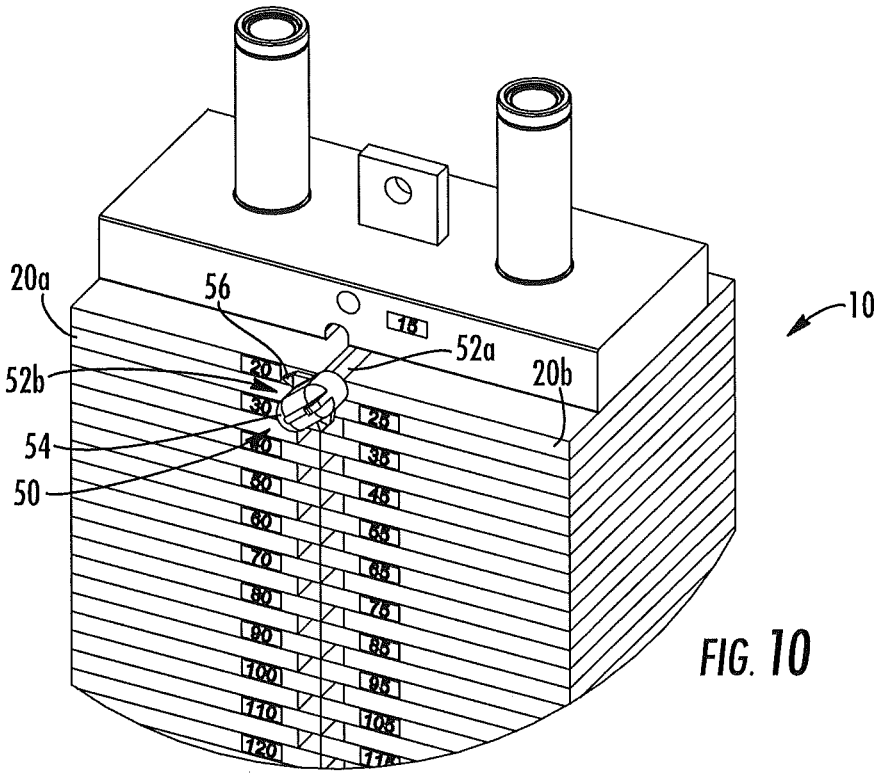
FIG. 10 is an enlarged view of the weight stack of FIG. 1 in which an alternative embodiment of a selector fork is employed, wherein the selector fork is in a first orientation in which 20 pounds of resistance is selected.
Figure 11:
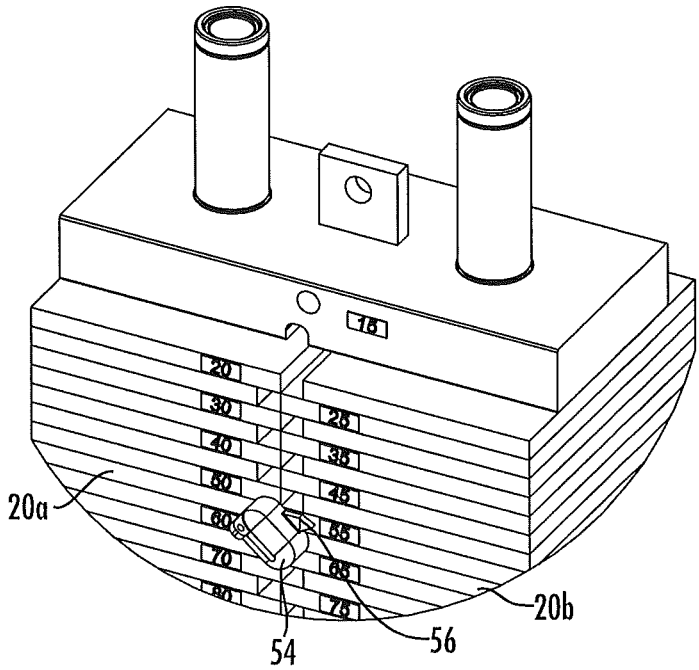
FIG. 11 is an enlarged view of the weight stack and selector fork of FIG. 10, wherein the selector fork is in a second orientation in which 55 pounds of resistance is selected.

FIGS. 10 and 11 illustrate the weight stack 10 utilizing a differently configured selector fork 50. The selector fork 50 includes two prongs 52*a*, 52*b* that extend from a head 54. Two pointers 56 extend from the head 54, one from each side, such that the pointers 56 define generally a right angle.

As shown in FIG. 10, the selector fork 50 can be inserted into the weights 20 by orienting the head 54 so that the prongs 52*a*, 52*b* define a 45 degree angle relative to a plane defined by any of the weights 20. In this orientation, the prongs 52*a*, 52*b* can be received within respective slots 22 of two immediately adjacent weights 20*a*, 20*b* and inserted into the holes 16*a*, 16*b* of the center post 15 that corresponds to those particular slots 22. Thus, the prongs 52*a*, 52*b* will be inserted into one hole 16*a* and one hole 16*b*. In this position, one of the prongs 52*a*, 52*b* will underlie the weight 20 immediately above it and support it from underneath.

In selecting a particular resistance for exercise, the exerciser should insert the selector fork 50 so that the upper weight 20 of the two immediately adjacent weights 20*a*, 20*b* that receive the selector fork prongs 52*a*, 52*b* represents the desired resistance. For example, in FIG. 10, the upper weight 20*b* is designated "20", and the lower weight 20*a* is designated "25"; the resistance that would be provided by such insertion would be the 20 pounds of the upper weight 20' and the weights above it. As can be seen in FIG. 6, the pointers 56 are positioned so that one pointer 56 always points to the upper weight 20*b* upon insertion of the selector fork 50 into the slots 22, thereby clearly indicating to the exerciser the magnitude of the resistance.

The selector fork 50 is used in the orientation shown in FIG. 10 to select weights 20*b* that are oriented with their slots 22 aligned with the column of holes 16*b*. It can be seen in FIG. 11 that, by rotating the selector fork 50 90 degrees counterclockwise from its orientation in FIG. 10, the user can select weights 20*a* that are oriented with their slots 22 aligned with the column of holes 16*a*. In this orientation, one of the pointers 56 indicates the magnitude of the resistance to be experienced by the exerciser. Thus, the single selector fork 50 can be used to select any incremental magnitude of resistance that can be created with the weights 20.

Figure 12:
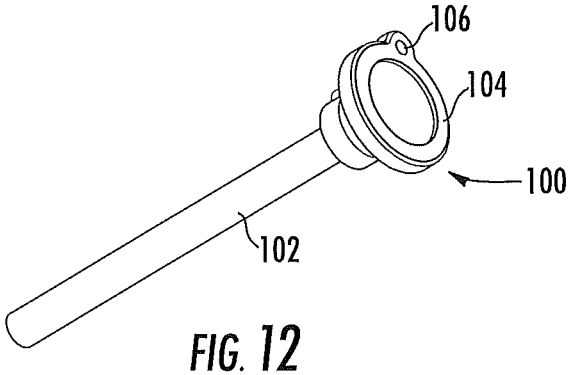
FIG. 12 is a perspective view of a selector pin according to additional embodiments of the present invention.

Referring now to FIG. 12, another embodiment of a selector device, in this instance a selector pin 100, is shown therein. The selector pin 100 includes a prong 102 and a head 104. The head 104 includes a tether attachment projection 106.

Figure 13:
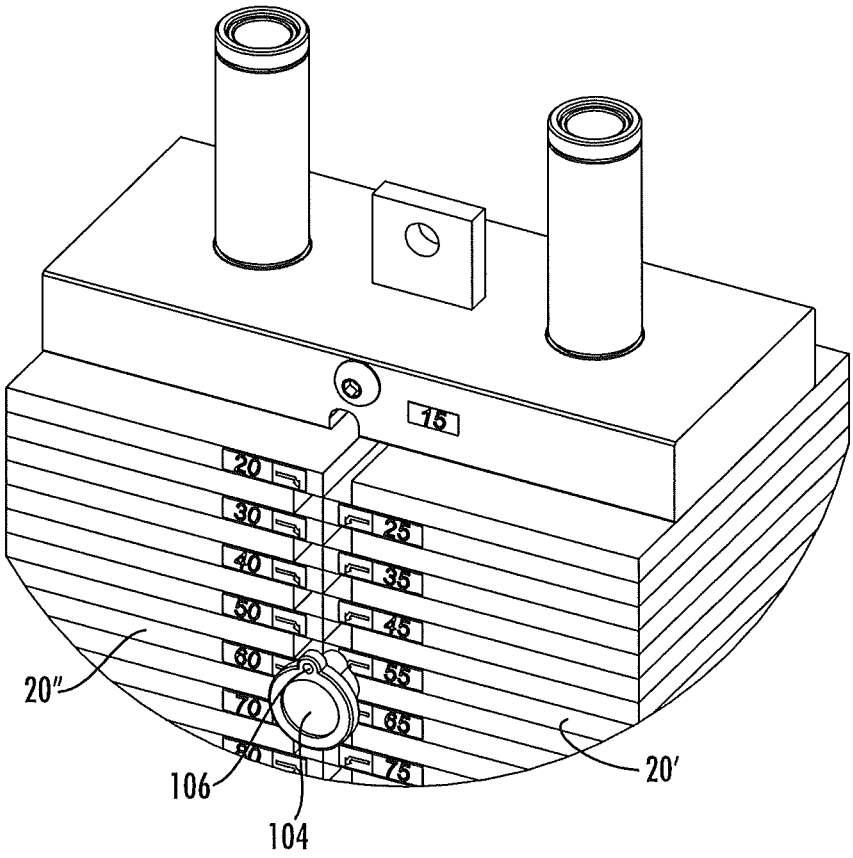
FIG. 13 is an enlarged perspective view of the weight stack of FIG. 1 in which the selector pin of FIG. 12 is employed, wherein 55 pounds of resistance is selected.

As shown in FIG. 13, the selector pin 100 can be used with the weight stack 10 by inserting the prong 102 into one of the slots 22 and subsequently into one of the holes 16*a*, 16*b* of the center post 15. The resistance experienced by the exerciser is represented by the weight 20' immediately above the weight 20" that includes the slot 22 into which the selector pin 100 is inserted. As can be seen in FIG. 13, each of the weights 20 includes an arrow indicator that points downwardly toward the slot 22 of the weight 20 immediately below it, thereby indicating the upper weight 20 as the resistance for a selector pin 100 inserted into that slot 22 (for example, 55 pounds is the resistance experienced in FIG. 13).

Those skilled in this art will recognize that, although the weights 20 are illustrated as being 5 pound weights, weights of a different magnitude (e.g., 10 pound weights) may also be used. Also, the weights 20 are shown as being generally rectangular in shape, but may take other shapes (e.g., circular, oval, or triangular) as desired.

Other variations from the illustrated embodiments are also contemplated. For example the center post 15 may take a different cross-sectional shape, or in some embodiments two separate, parallel center posts may be employed. Also, selector units other than the selector pin and selector forks may be employed. Further deviations from that illustrated and explicitly described may also be employed.

It should also be noted that the weight stack assembly 10 may be employed with a variety of exercise machine types. For example, the weight stack assembly 10 may be employed with: machines for leg exercise, such as leg curl, leg press, and calf machines; machines for hip exercise, such as hip abduction, adduction, and abduction/adduction machines, machines for neck exercise, such as 4-way neck, behind neck, and neck and shoulders machines; machines for the upper torso, such as 10-degree and 50-degree chest, chest and double chest, declined and inclined press, bench press, reverse and super pullover, torso arm, seated dip, rowing back, and compound row machines; machines for the mid-torso, such as abdominal, lower abdominal, rotary torso, and low back machines; machines for the arms, such as multi-biceps, multi-triceps, and super forearm machines; and machines for the shoulders, such as lateral raise, overhead press, and rotary shoulder machines.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A weight stack for an exercise machine, comprising:

a plurality of weights arranged in a vertical stack, each of the weights including an open-ended, forwardly facing slot, wherein the slots of each of a first set of the weights form a first column, and wherein the slots of each of a second set of the weights form a second column that is parallel to but non-coincident with the first column, and wherein the vertical stack is formed by alternating first and second weights.

2. The weight stack defined in claim 1, wherein the first set of weights and the second set of weights have substantially identical weight.

3. The weight stack defined in claim 1, wherein each of the weights includes an aperture connected with its slot, the aperture configured to receive a center post.

4. The weight stack defined in claim 3, wherein the aperture of each weight is located generally in the center of the weight.

5. The weight stack defined in claim 1, wherein the weights are between about ¼ and ¾ inch in thickness.

6. A weight stack assembly for an exercise machine, comprising:

a plurality of weights arranged in a vertical stack, each of the weights including an open-ended, forwardly facing slot, wherein the slots of each of a first set of the weights form a first column, and wherein the slots of each of a second set of the weights form a second column that is parallel to but non-coincident with the first column, and wherein the vertical stack is formed by alternating first and second weight;

a post extending through the plurality of weights, the post configured to connect with a movement arm of an exercise machine, the post including a first column of apertures that align with the slots of the first set of weights and a second column of apertures that align with the second set of weights; and a selector unit configured to be inserted into one of the slots and one of the apertures to select a portion of the weights to provide resistance for exercise.

7. The weight stack assembly defined in claim 6, wherein the selector unit includes a single prong.

8. The weight stack assembly defined in claim 7, wherein the selector unit further comprises an indicator that designates the weight immediately above the selector unit prong.

9. The weight stack assembly defined in claim 6, wherein the selector unit includes a pair of prongs.

10. The weight stack assembly defined in claim 9, wherein one of the prongs is inserted into one of the slots of the first set of weights and one of the first column of apertures, and one of the prongs is inserted into one of the slots of the second set of weights and one of the second column of apertures.

11. The weight stack assembly defined in claim 10, wherein the selector unit further comprises an indicator that designates the weight of the higher of the first and second weights into which the prong is inserted.

12. The weight stack assembly defined in claim 9, wherein each of the prongs is inserted into a slot of the first set of weights and an aperture from the first column of apertures.

13. The weight stack assembly defined in claim 12, wherein the selector unit further comprises an indicator that designates the weight of the second set of weights located between the prongs.

14. The weight stack assembly defined in claim 6, wherein the weights are between about ¼ and ¾ inch in thickness.

* * * * *